US006598755B1

(12) United States Patent
Pedullà et al.

(10) Patent No.: US 6,598,755 B1
(45) Date of Patent: Jul. 29, 2003

(54) DISPOSABLE BOTTLE HAVING A GRADUALLY COLLAPSIBLE, RECOVERY-FREE, STRUCTURE OF ITS SIDE-WALLS

(76) Inventors: Christian Pio Pedullà, Via Monte Grappa, Milan (IT), 920124; Gianfilippo Pagliacci, Via Cassiodoro, Milan (IT), 1220145

( * ) Notice: Subject to any disclaimer, the term of this patent is extended or adjusted under 35 U.S.C. 154(b) by 0 days.

(21) Appl. No.: 09/890,100

(22) PCT Filed: Jan. 26, 2000

(86) PCT No.: PCT/IB00/00079

§ 371 (c)(1),
(2), (4) Date: Jul. 27, 2001

(87) PCT Pub. No.: WO00/44630

PCT Pub. Date: Aug. 3, 2000

(30) Foreign Application Priority Data

Jan. 27, 1999 (IT) ..... MI99A0142

(51) Int. Cl.[7] ..... B65D 1/02; B65D 1/32

(52) U.S. Cl. ..... 215/382; 215/900; 215/381; 220/666; 220/672

(58) Field of Search ..... 215/282, 900, 215/379, 381; 220/666, 669, 667, 672, 907; 222/107, 215

(56) References Cited

U.S. PATENT DOCUMENTS

| | | | | | |
|---|---|---|---|---|---|
| 2,899,110 | A | * | 8/1959 | Parker | 215/382 X |
| 3,301,293 | A | | 1/1967 | Santelli | 220/666 |
| 4,492,313 | A | | 1/1985 | Touzani | |
| 4,773,458 | A | * | 9/1988 | Touzani | 215/900 X |
| 4,921,147 | A | | 5/1990 | Poirier | |
| 5,015,515 | A | * | 5/1991 | Paulin | 138/121 X |
| 5,261,319 | A | * | 11/1993 | Laville et al. | 92/47 |
| 5,573,129 | A | * | 11/1996 | Nagata et al. | 215/382 |
| 5,584,413 | A | * | 12/1996 | Jung | 215/232 X |
| 5,615,791 | A | * | 4/1997 | Vatelot et al. | 215/382 |
| 5,638,995 | A | * | 6/1997 | Mazda | 222/215 |

FOREIGN PATENT DOCUMENTS

| | | | | |
|---|---|---|---|---|
| DE | 89 00 480.9 | U1 | 3/1989 | |
| DE | 295 12 226 | U1 | 9/1995 | |
| EP | 0 801 002 | A1 | 10/1997 | |
| EP | 0 850 842 | A1 | 7/1998 | |
| FR | 2504095 | * | 10/1982 | 220/666 |

* cited by examiner

*Primary Examiner*—Sue A. Weaver
(74) *Attorney, Agent, or Firm*—Young & Thompson

(57) ABSTRACT

A disposable bottle (1) having a gradually collapsible structure, of the type in which the sidewalls (2) of the bottle have an accordion-like structure comprising several adjacent folds. Each fold is formed by two opposed surfaces (7, 8) of different width, comprising blocking means to prevent the recovery of the fold, under a predetermined force, once the same fold has collapsed for the first time.

6 Claims, 3 Drawing Sheets

41
40

31
36
37
38
30

21
26
20

DISPOSABLE BOTTLE HAVING A GRADUALLY COLLAPSIBLE, RECOVERY-FREE, STRUCTURE OF ITS SIDE-WALLS

FIELD OF THE INVENTION

The present invention refers to a disposable bottle or container having a gradually collapsible, recovery-free, structure of its sidewalls.

More particularly, the disposable bottle according to the invention is provided with accordion-like sidewalls, which can be collapsed step-by-step as the internal content of the bottle is used up, so as to maintain practically constant the volume of air at the top of the bottle. At the same time, the volume of the bottle is reduced in proportion to its actual content, saving space in the places wherein the bottle or container is stored. Finally, when the content of the bottle is completely used up, the bottle has reached its minimum volume and can therefore be directly thrown away, without any further compacting operation, as is usually required for empty containers so as to reduce the bulkiness of the rubbish.

BACKGROUND OF THE INVENTION

Bottles and containers of this general kind have already been proposed in prior art without, however, having provided technical solutions apt to be satisfactorily used for the above purposes. At present, a disposable bottle which actually—and not only in theory—provides the positive features described heretofore is therefore still lacking on the market, for the reasons that will be explained in further detail hereinafter.

A first bottle of this kind proposed in prior art was, in fact, a bottle formed of a plastic material having substantially elastic properties at room temperature and shaped, for at least part of its height, as an accordion; each bellows element of the accordion (hereinafter simply indicated as "fold") was formed by opposed conical surfaces having the same width. This type of container was provided to house liquids that undergo a quick degradation upon contact with air as, for example, photographic developers. After having drawn a quantity of liquid from this bottle, and before closing it again, the accordion-like portion of the bottle had to be squeezed to an extent sufficient to permit the liquid content, still held therein, to reach the neck of the bottle, then reducing to a minimum level the quantity of air entrapped in the bottle. Due to the elastic properties of the bottle material and, above all, to the symmetric shape of each fold of the accordion-like structure, this operation must be accomplished each time that some liquid has to be drawn from the bottle, since said accordion-like structure has only one position of stable equilibrium, i.e. its extended position. The above described type of bottle is therefore not suitable to be used in applications wherein a frequent use of the bottle content is requested, as for example in the case of beverages.

Another type of collapsible bottle has therefore been proposed in prior art, wherein each fold of the accordion-like sidewalls of the bottle is provided with two positions of stable equilibrium, i.e. an extended position and a collapsed position, thanks to the fact that the two opposed conical surfaces forming each fold have a different width and the smaller surface can therefore be steadily housed, in a collapsed configuration, inside the adjacent larger surface. As the content of the bottle is used up, the consumer may cause the progressive collapsing of each fold, and the bottle steadily remains in the collapsed configuration, at least until an external force is applied to return the collapsed folds into the extended equilibrium position. An example of this second type of collapsible bottle is disclosed in U.S. Pat. No. 4,492,313.

Notwithstanding the above-described improvement, even this second type of collapsible bottle has however not reached a satisfactory industrial application, due to the fact that it still involves the significant drawback of a low resistance against the return of the collapsed folds to the original extended position, as hereinafter described.

This drawback is actually due to the fact that the stable equilibrium position of each fold of the accordion-like sidewalls of the bottle, in the collapsed configuration, has on an average, a rather low degree of stability. It is thus possible, at any time, to return the bottle from the collapsed to the extended configuration, by simply applying on the bottle a force of sufficient intensity in an appropriate direction, as it happens, for example, when a bottle is filled with a gassed liquid, or when it is overturned to pour its content, or in handling the same.

The above-described restriction of use in respect with gassed beverages is particularly unfavourable. In fact, it should be kept in mind that gassed beverages form an important share of products that could possibly and advantageously be packed in a collapsible container. The taste and the gas content of said beverages, even when the same are partly used up, could in fact be preserved for a long while.

This result, however, although expected in theory, has not been up to date achieved in practice. In fact, the gas pressure developed inside the bottle, once the same has been closed in a collapsed or partially collapsed configuration, is sufficiently high to return soon or later the bottle in a more extended or fully extended configuration, thereby forming in the bottle that empty space which purportedly should be avoided.

The same inconvenience, however, also happens when the content of the bottle is a flat liquid, especially a viscous one, or a solid particulate, each time the bottle is overturned for storing purposes or simply to pour its content. In this case, in fact, the weight of the bottle content pressing onto the top portion of the same is often sufficient to return the bottle to its extended configuration.

OBJECT OF THE INVENTION

In EP-A 850 842 is disclosed a collapsible container wherein each of the bellows element is formed by opposed conical surfaces having the same width, so rendering impossible any stable collapsed configuration of the container. Moreover the indentations provided in one of said surfaces are non apt to regularly determine one specific and desired collapsed configuration of the bellows.

The object of the present invention is to thus supply a disposable bottle having a gradually collapsible accordion-like structure of its sidewalls, wherein each fold of said structure, once it has been collapsed, is provided with a high degree of stability, i.e. in the normal use and storage conditions, even with gassed liquids, it is substantially prevented from returning into an extended position (recovery-free).

SUMMARY OF THE INVENTION

This object is reached, according to the present invention, with a disposable bottle having a gradually collapsible structure, of the type in which the sidewalls of the bottle have an accordion-like structure comprising several adjacent folds, each fold being formed by two opposed surfaces of different width, characterised in that said fold-forming surfaces comprise blocking means apt to prevent the recovery of the fold, under a predetermined force, once the same fold has been collapsed for the first time.

In a first embodiment of the invention, said blocking means are obtained by providing that at least the smaller surface, of the two surfaces forming each fold, has an arched shape and that the convexity of said surface is directed towards the adjacent larger surface against which it collapses.

In a second embodiment of the invention, said blocking means are instead obtained by providing a peripheral groove on one of the surfaces of each fold and a co-operating matching rib on the other one of said surfaces.

According to a feature of the invention, one or more cylindrical annular sections are moreover provided on the bottle sidewalls, apt to interrupt the accordion-like structure thereof, to stiffen the bottle and prevent any possible ovalization of thereof during the collapsing action.

BRIEF DESCRIPTION OF THE DRAWINGS

Further features and advantages of the present invention will clearly result from the following detailed description of some preferred embodiments thereof, illustrated on the accompanying drawings, wherein.

DETAILED DESCRIPTION OF THE INVENTION

Figure 1:
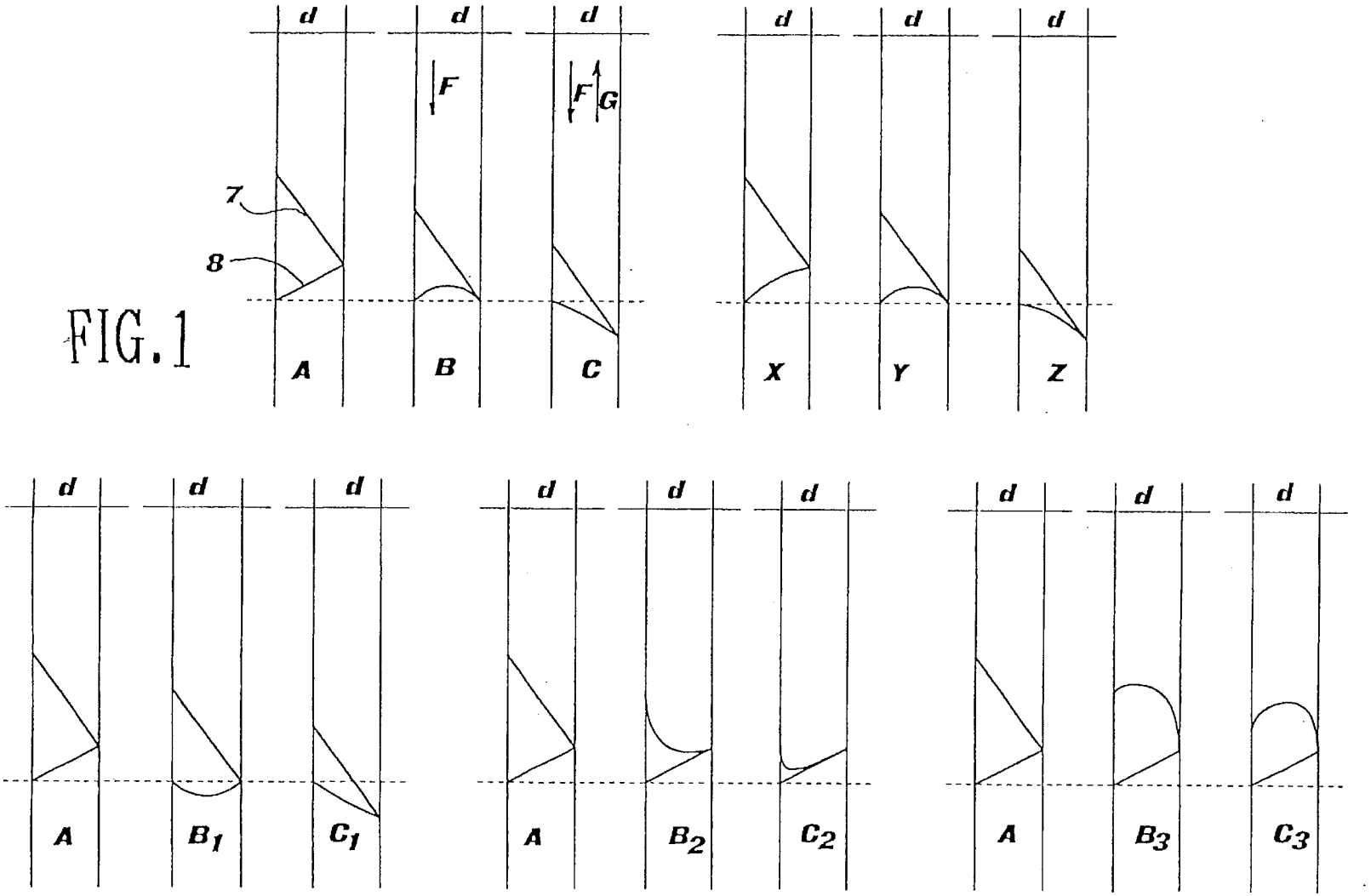
FIG. 1 is a diagram showing a possible explanation of the collapsing mechanism of a bottle having an accordion-like structure of its sidewalls, according to the prior art discussed in the introduction of this specification.

In the drawings and in the following description, reference will be made exclusively to bottles having a circular section. The invention is however not limited to this shape of bottle and can be equally applied to bottles having pseudo-circular, polygonal, square with rounded angles, and other similar sections.

In the first embodiment of the present invention, the object to obtain a steady collapsing of the single folds of the accordion-like structure, is reached by simply forming the smaller surface of each fold as an arched surface, instead of a conical surface as in the bottles according to prior art (in a diametrical section said surface is thus represented by an arc-shaped segment, instead of a straight-line segment). To reach this object, it is furthermore necessary for the convexity of said arched surface to be directed towards the adjacent larger surface, against which the arched surface collapses.

Figures 2, 3, 4, 5:
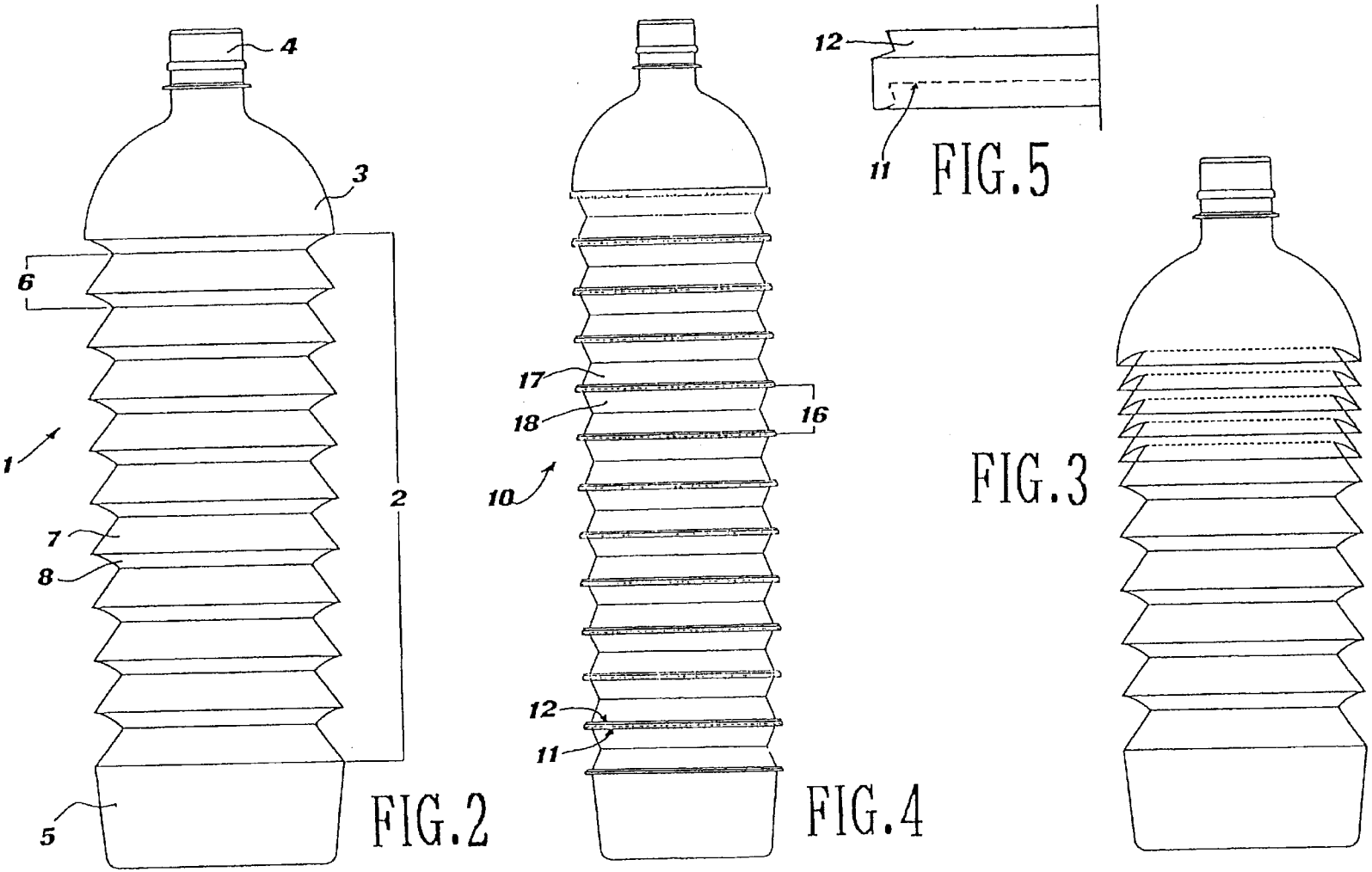
FIG. 2 is a schematic front view of a bottle according to a first embodiment of the present invention, in an extended configuration.
FIG. 3 is a schematic front view of the bottle of FIG. 2, in a partially collapsed configuration.
FIG. 4 is a schematic front view of a bottle according to a second embodiment of the present invention, in an extended configuration.
FIG. 5 is a detailed enlarged view of the blocking means provided in the bottle of FIG. 4.

A bottle according to this first embodiment is shown in FIG. 2. The bottle 1 comprises accordion-like sidewalls 2, a top portion 3 with a neck 4, onto which is screwed a cap, and a bottom portion 5. The accordion-like sidewalls 2 are formed by a number of bellows elements 6—which, as already said, are simply indicated hereinafter as "folds", and the number of which is in relation to the height of the bottle—having two opposed surfaces, respectively a larger surface 7 and a smaller surface 8.

The smaller surface 8—which, preferably but not necessarily, is the lower surface of each fold 6—is an arched surface, preferably according to a circular arc, the convexity of said surface 8 being directed towards the corresponding larger surface 7 of the same fold, against which it collapses.

Said larger surface 7 is normally a conventional conical surface, but it may all the same be an arched surface. In this last case, the concavity of said surface 7 must be directed towards the smaller surface 8 which collapses against the same.

The top and bottom portions 3 and 5 of the bottle can have any known shape, depending on the final use of the bottle or container according to the invention. It is however preferable for the top portion 3 not to be directly connected to the first fold 6, but for an arched surface 8 to be interposed between them, so that, when the bottle is collapsed, said interposed surface 8 will collapse inside the top portion 3, thereby improving the collapsing action of the bottle.

Thanks to this particular configuration of the accordion-like sidewalls 2 of the bottle 1, once said bottle is gradually collapsed as its content is used up, the folds 6 easily take up a very steady collapsed configuration, as shown in FIG. 3. When, in fact, a force is applied onto the bottle, in a direction of its extension, for example due to the gas pressure formed inside the bottle or due to the weight of its content when the bottle is overturned, the collapsed folds 6 do not undergo any recovery. Thanks to the particular "closed" configuration of the collapsed folds 6, under the action of said force the folds 6 are, in fact, forced to further tighten, instead of re-opening, thereby completely reaching the object of the invention.

What has been stated above of course applies to forces which are not particularly high, just like the forces which can be developed in the above described circumstances occurring in the normal use of the bottle. The resistance opposed by the folds 6 against their re-opening can be increased, by increasing the bending degree of the surface 8, or by forming both the surfaces 7 and 8 as arched surfaces, in the manner described heretofore, so that, in a collapsed configuration, the two surfaces of a fold 6 are perfectly superposed and tight.

A possible technical explanation of the surprisingly positive result achieved with the above embodiment is now given making reference to FIG. 1, but this explanation must in no way be considered as limiting the scope of the present invention.

FIG. 1A schematically illustrates a fold 6 of an accordion-like structure according to the prior art in an extended configuration, while FIGS. 1B and 1C illustrate the same fold in successive steps of intermediate and complete collapsing under the action of a compression force F. The height of the fold 6, indicated by reference d, is determined by the geometric features of the bottle and, save for local deformations, is substantially constant when collapsing the bottle.

The kind of deformation shown in step B is the only one determined by the Applicants, in their studies, as desirable, since it leads to a final configuration C wherein the residual bending of the smaller surface 8 is such that it offers a bigger shape resistance against a re-opening force G having a direction opposite to the force F. However, in a fold 6 formed by conical surfaces according to prior art, at least other three types of deformation are certainly possible, schematically shown as steps B1, B2 and B3. Such types of deformation lead to undesirable final configurations C1, C2 and C3 of the collapsed fold 6. These configurations, in fact, have a steadiness against recovery that: for the C1 configuration is far less than for the C configuration; and for the C2 and C3 configurations is practically nought, as the deformation has occurred in the larger upper surface 7 only.

By pre-forming the smaller surface 8 as an arched surface, according to the teachings of the present invention, and as shown in FIG. 1X, the deformation of the fold 6 always occurs according to the deformation step Y and the final Z configuration. This last configuration is still more steady of the above said C configuration, both due to the higher final bending of the surface 8, and because this surface, having been formed as an arched surface in advance, undergoes a lesser yielding in the deformation step Y. It is so possible to reach the desired goal of a collapsible bottle that, in its collapsed configuration, has a high steadiness and is recovery-free.

The same goal can be achieved by the bottle 10 according to the embodiment shown in FIGS. 4 and 5. In this second embodiment, the two surfaces 17 and 18 forming each fold 6 can be either conical (as shown in the drawings) or arched surfaces. At the peripheral edge of said surfaces a coupling is formed, said coupling being apt to snap with matching couplings provided on the adjacent folds 16, when the bottle 10 is collapsed, mutually blocking adjacent folds in their collapsed configuration. Such a coupling can, for example, be formed by a groove 11 formed on the higher portion of the lower surface 18 of each fold and a matching rib 12 formed on the lower portion of the upper surface 17.

In FIG. 5 is shown in better detail the shape of the groove 11 and of the rib 12. In any case, the particular type of mechanical snap coupling between the peripheral portions of the surfaces 17 and 18 is not critical for reaching the object of the invention and can therefore be freely chosen according to specific economic and design needs.

The bottle according to the invention can finally comprise on or more cylindrical annular stiffening sections, as shown in FIG. 6. The insertion of such stiffening sections permits to strongly reduce the quantity of plastic material needed in making the bottle, without having any unfavourable consequence, as bending of the bottle during its use or ovalization of the bottle during collapsing thereof.

Figures 6A, 6B, 6C:
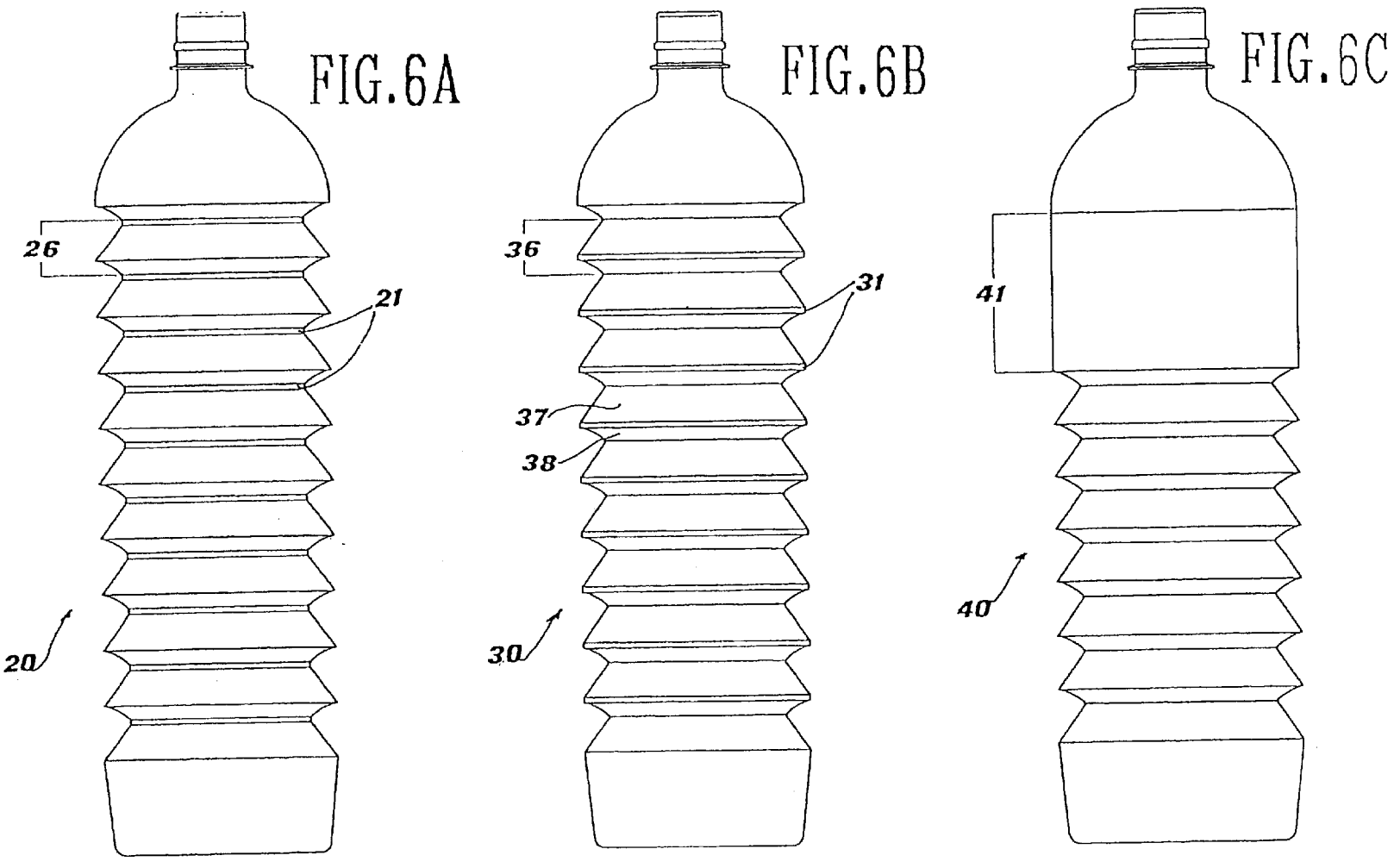
FIGS. 6A, 6B and 6C are three schematic front views of a bottle according to the present invention provided with stiffening annular sections, arranged in different numbers and ways.

In FIG. 6A a bottle 20 comprises a plurality of stiffening sections 21 having a low height, positioned at the bottom, that is, at an inner apex, of each fold 26.

In FIG. 6B a bottle 30 comprises a similar plurality of stiffening section 31 positioned at the top, that is, at an outer apex, of each fold 36. In such embodiment the collapsing of the bottle is still more efficient and steady, since providing sections 31 allows a better "closure" of the surface 38 by the surface 37. Moreover, when the bottle is in its extended configuration, several sections 31 can be used as a support, by a conventional labelling plant, for applying on the same a bottle label.

In FIG. 6C finally, the bottle 40 has only one stiffening section 41, said section being higher than the section 31 or 21 and therefore able to bear a label in a conventional way. The position of said section 41 can evidently be chosen at will all along the bottle 40, according to the specific needs of the producer.

The bottle or container according to the present invention is preferably formed by blow moulding a suitable plastic material, as for example PET, PE, PVC and other similar materials. This bottle can however be successfully formed by other production methods or made in other materials as metals, paper, cardboard and other materials.

The present invention has been described making a particular reference to some preferred embodiments thereof, but it should be clear that a number of variations at the reach of a skilled man could be made to such embodiments without departing from the scope of the invention, as defined in the appended claims.

What is claimed is:

1. A disposable bottle having a gradually collapsible structure, of the type in which the sidewalls (2) of the bottle have an accordion-like structure comprising several adjacent folds (6, 26, 36), each fold being formed by two opposed surfaces of different area, characterized in that at least the smaller surface (8), of the two surfaces forming each fold, has an arched shape, and that the convexity of said surface is directed towards the adjacent larger surface (7) against which it collapses.

2. Disposable bottle as in claim 1, further comprising one or more cylindrical annular sections (21, 31, 41) in the bottle sidewalls.

3. Disposable bottle as in claim 2, wherein said sections (31) have a height lower than the height of said smaller surface (8) and are positioned at an outer apex of said folds.

4. Disposable bottle as in claim 2, wherein said sections (21) have a height lower than the height of said smaller surface (8) and are positioned at an inner apex of said folds.

5. Disposable bottle as claimed in claim 1, wherein said larger surface (7) is of truncated conical shape.

6. Disposable bottle as in claim 2, comprising only one (41) of said sections, the height of which is equal to the height of a group of said folds.

* * * * *